US006336417B1

(12) United States Patent
Kawahito et al.

(10) Patent No.: US 6,336,417 B1
(45) Date of Patent: Jan. 8, 2002

(54) APPARATUS FOR DETECTING DEFECTIVE SEWING BY A SEWING MACHINE

(75) Inventors: Toshio Kawahito, Osaki; Masahito Saito, Tokushima, both of (JP)

(73) Assignee: Pagasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/922,781

(22) Filed: Aug. 7, 2001

(30) Foreign Application Priority Data

Sep. 6, 2000 (JP) ..... 12-269653

(51) Int. Cl.[7] ..... D05B 69/36
(52) U.S. Cl. ..... 112/470.01; 112/272; 112/277
(58) Field of Search ..... 112/470.01, 272, 112/277, 273, 275, 278, 475.02, 475.03

(56) References Cited

U.S. PATENT DOCUMENTS 4,924,790 A * 5/1990 Kondo ..... 112/272
4,967,676 A * 11/1990 Hagino et al. ..... 112/277 X

FOREIGN PATENT DOCUMENTS

JP 59-25349 7/1984

* cited by examiner

*Primary Examiner*—Peter Nerbun
(74) *Attorney, Agent, or Firm*—Jones, Tullar & Cooper, P.C.

(57) ABSTRACT

An apparatus according to the present invention comprises a sensor and a control circuit. The sensor is disposed near a needle drop portion of a needle plate and detects the quantity of light transmitted through cloths passing over the needle plate. The control circuit determines defective sewing from increase and decrease of said light quantity. The control circuit comprises means for storing the averaged value of the light transmitted in a few stitches of initial sewing operation, and means for determining defective sewing continuously from the initial sewing operation by comparing the average value with the value of the light transmitted and detected each time. Thus, it is possible to immediately start the practical sewing operation without taking time for test sewing or other extra jobs even when every cloth to be sewn is different in properties.

7 Claims, 4 Drawing Sheets

APPARATUS FOR DETECTING DEFECTIVE SEWING BY A SEWING MACHINE

BACKGROUND OF THE INVENTION

1. Field of the Invention

The present invention relates to an apparatus for detecting defective sewing by the sewing machines, which is configured to detect the quantity of light transmitted through a cloth passing over a needle plate during sewing operation in order to check for defective sewing from increase and decrease of said transmitted light.

2. Description of Prior Art

When a cloth is sewed by a sewing machine, defective sewing such as misalignment and plyshift are liable to take place. Misalignment, as shown in FIG. 4, is such that cloths W1, W2, placed one over the other, are shifted along the direction of the arrow X orthogonal to the forward sewing direction, that is, the direction of the arrow Y going along the cloth feeding direction F, and thereby, side ends W1*a*, W2*a* of the cloths W1, W2 become uneven with each other. Plyshift, as shown in FIG. 5, is such that the cloths W1, W2 are shifted along the direction of the arrow Y, and thereby, terminal ends W1*b*, W2*b* of the cloths W1, W2 become uneven with each other. In order to obtain well-finished sewing products, it is required to quickly detect occurrence of defective sewing such as misalignment and plyshift during sewing operation.

To meet such requirement, there is a conventional proposal of an apparatus for detecting defective sewing by the sewing machines as is disclosed in Japanese Utility Model Publication No. 59-25349. This apparatus comprises a sensor which is located at a side of a needle drop portion of a needle plate and serves to detect the quantity of light transmitted through a cloth passing over the needle plate, and a control circuit which serves to determine with or without defective sewing from increase and decrease of said light quantity. And in this apparatus, the inspection light is projected on one side of the surface and the back of the cloth passing over the needle plate, and the inspection light passing through the cloth is received at the other side of the cloth, and thereby, the increase and decrease of the received light quantity are determined to detect defective sewing.

However, in the case of using an optical transmission type sensor as described above, the quantity of the inspection light passing through the cloth varies depending upon the properties of the cloth such as thickness, material and color. Accordingly, in a conventional apparatus using such the optical transmission type sensor, it is necessary to make the adjustment of the reference transmission level, that is, to adjust the sensibility of the sensor by executing a test sewing operation before start of sewing the intended cloth, therefore, extra time is spent and the operation efficiency can not enhance.

Also, in a conventional apparatus, when defective sewing is detected, occurrence of defective sewing is informed to the operator by giving a warning sound, but the warning sound is a single sound and, therefore, it is difficult to identify the sewing machine in sewing trouble when a plurality of machines equipped with relevant apparatus are operated adjoining to each other. Further, in a conventional apparatus, it is unable to cancel the detection of defective sewing and to meet requirements for sewing special products.

SUMMARY OF THE INVENTION

It is an object of the present invention to provide an apparatus for detecting defective sewing by the sewing machines, that is capable of detecting defective sewing precisely and performing immediately the practical sewing while improving the operation efficiency without need of adjusting the sensitivity of the sensor by test sewing or the like even in case of sewing cloths different in properties.

It is another object of the present invention that the sewing machine occurring defective sewing identifies quickly even when a plurality of sewing machines are operated at the same time.

To achieve the object, the apparatus includes a sensor for detecting the quantity of light transmitted through a cloth passing over a needle plate, and a control circuit for checking occurrence of defective sewing from increase and decrease of said light quantity. The sensor is disposed near a needle drop portion of the needle plate. A feature of the present invention is that the control circuit comprises means for storing the average value of the light quantity transmitted in a few stitches of initial sewing operation, and means for determining defective sewing during sewing operation continuously the initial sewing operation by comparing the stored average value with the value of the quantity of light transmitted and detected each time.

According to the present invention having the above configuration, when cloths set on the needle plate are sewn while passing through the needle drop portion, the quantity of light transmitted through the cloth is detected by a sensor near the needle drop portion. In that case, the storing means of the control circuit stores the average value of the quantities of light transmitted through the cloth in a few stitches of initial sewing operation. And in subsequent sewing operation, the value of the quantity of light transmitted and detected each time is compared with the stored average value of the quantities of transmitted light, thereby detecting defective sewing, that is, occurrence of trouble such as misalignment and plyshift. As a result, even when every cloth to be sewn is different in properties such as thickness, material, and color, it is possible to start the practical sewing immediately without taking much time and trouble for doing extra jobs such as adjusting the sensitivity of the sensor, and to precisely detect defective sewing, simultaneously improving the operation efficiency.

In this apparatus having the above configuration, the control circuit includes warning means for generating a warning sound in case of detecting defective sewing and a selective operation member which can change the warning sound from the warning means to a different kind of warning sound. In this way, when a plurality of sewing machines adjoining to each other are operated at the same time, the warning sound can be changed to a different kind of warning sound every sewing machine through the selective operation member, and thereby, it is possible to quickly and surely identify the sewing machine occurring defective sewing.

Also, in this apparatus having the above configuration, the control circuit includes further an invalid section setting member which can invalidate the detection of defective sewing during sewing operation in a predetermined section. In this way, since it is possible to invalidate the detection of defective sewing during sewing operation in the predetermined section, unnecessary detection of defective sewing and resultant generation of a warning sound can be avoided in sewing of special products, which includes a form of sewing section similar to misalignment or plyshift, and thereby, the intended special sewing can be appropriately performed.

The other objects and advantages of the present invention will be made clear in the following description of the embodiments.

PREFERRED EMBODIMENTS OF THE INVENTION

The preferred embodiments of the present invention will be described in the following with reference to the drawings.

Figure 1:
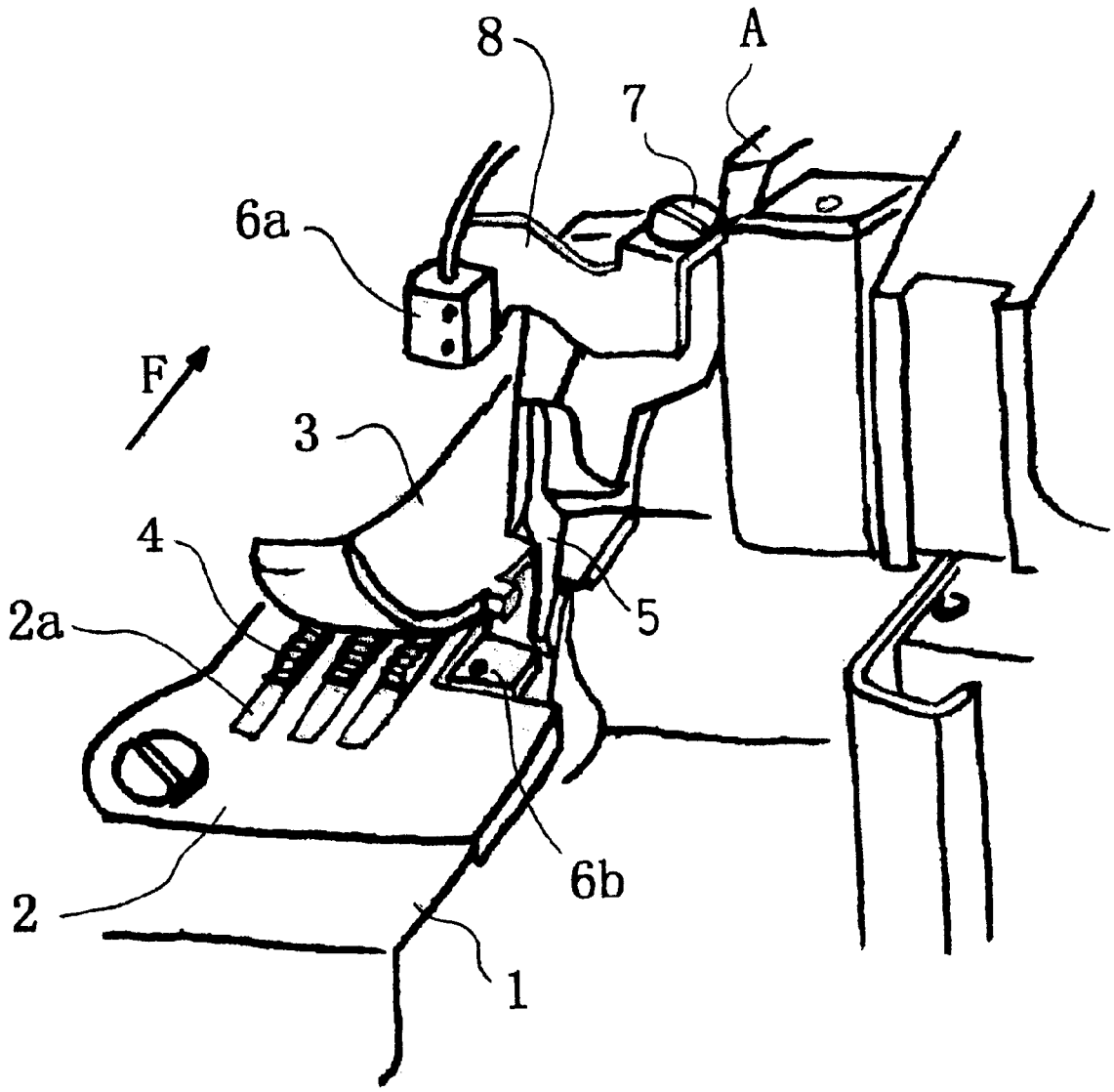
FIG. 1 is a perspective view of essential parts showing the embodiments of an apparatus for detecting defective sewing by the sewing machines according to the present invention.

FIG. 1 is a perspective view of essential parts showing the embodiments of an apparatus for detecting defective sewing by the sewing machines according to the present invention. A needle plate 2 of the sewing machine is disposed as a part of the cloth table 1, and has the top surface flush with the top of a cloth table 1. Cloths (not shown) placed on the needle plate 2 are fed in the direction of arrow F by collaboration of a presser foot 3 disposed above the needle plate 2 and a feed dog 4 moved in and out of a feed dog slot 2*a* formed in the needle plate 2. Also, a knife 5 is disposed at front side of a sewing needle (not shown) which penetrates the needle drop portion of the needle plate 2. The knife 5 moves up and down to cut the cloth edges evenly.

A sensor 6 is arranged at front side of the knife 5 in the cloth feeding direction F. The sensor 6 comprises a photo emission unit 6*a* and a photo acceptance unit 6*b*. The photo emission unit 6*a* is fixed to the end of a bracket 8 secured by screw 7 onto sewing machine frame A, and emits the inspection light downwards. The photo acceptance unit 6*b* is disposed nearly flush with the top of the needle plate 2 and accepts the inspection light emitted downwards from the photo emission unit 6*a*. The quantity of light accepted by the photo acceptance unit 6*b* varies in accordance with the thickness, the number of sheets, colors, etc. of the cloth passing over the needle plate 2. In this embodiment, the sensor 6 is located at front side of the knife 5 in the cloth feeding direction F, but not limited to this position, it is only required that the sensor 6 be located near the needle drop portion of the needle plate 2. Also, the positional structure of the photo acceptance unit 6*b* is not described in detail in the description of this embodiment, but its position is desirable to be adjustable along the direction of intersecting the cloth feeding direction F.

Figure 2:
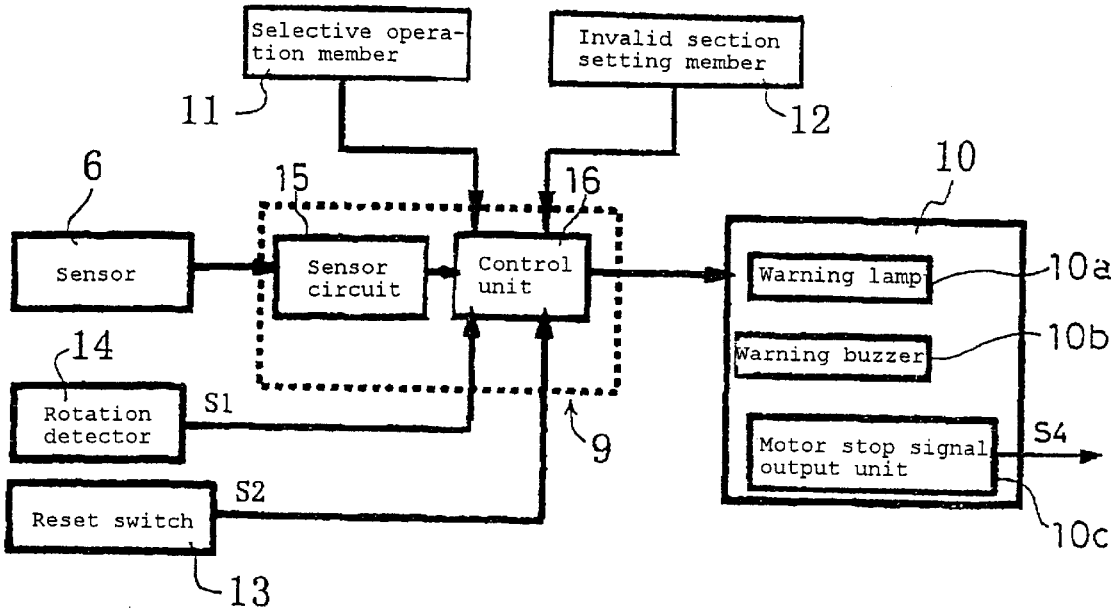
FIG. 2 is a block diagram showing the configuration of a control circuit in said apparatus.
Figure 3:
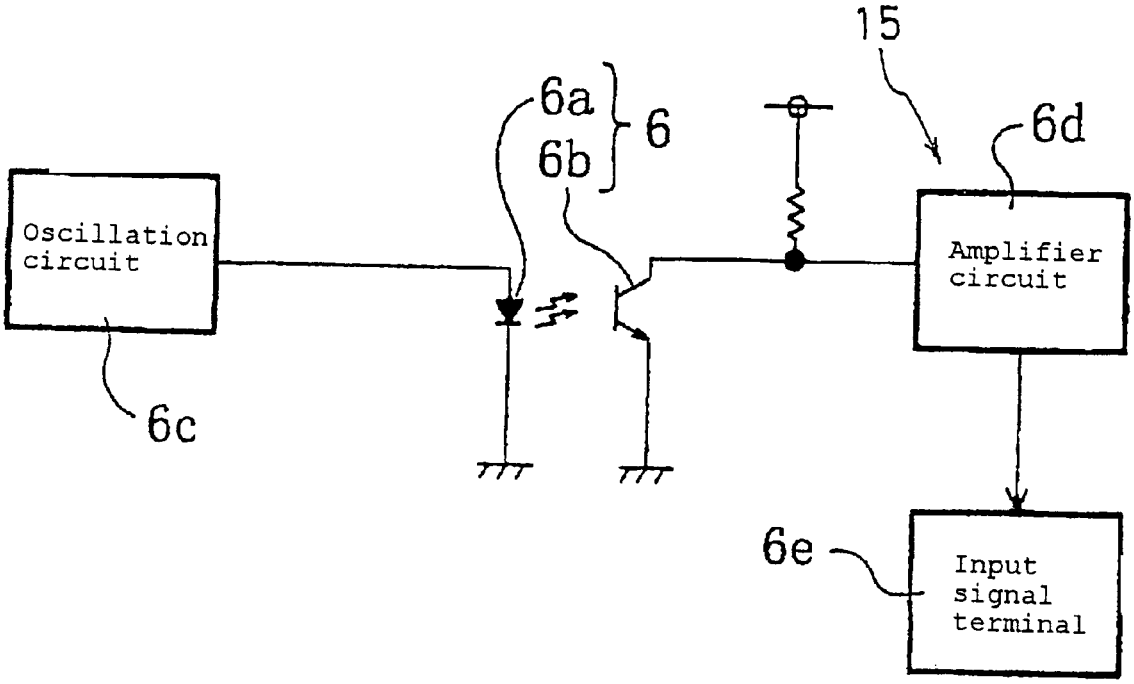
FIG. 3 is a block diagram showing essential parts in the configuration of a control circuit.
Figure 4:
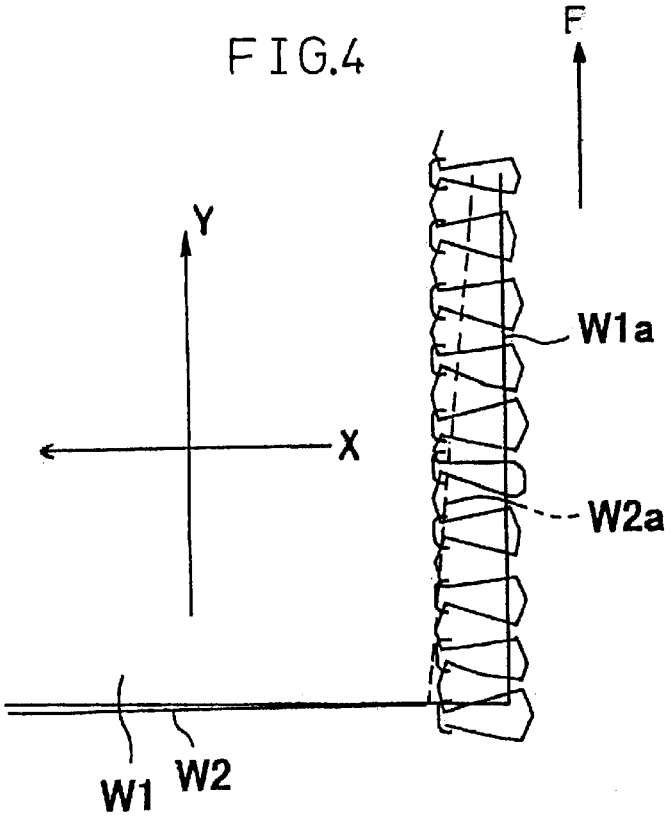
FIG. 4 is a plan view illustrating "misalignment" that is one of defective sewing.
Figure 5:
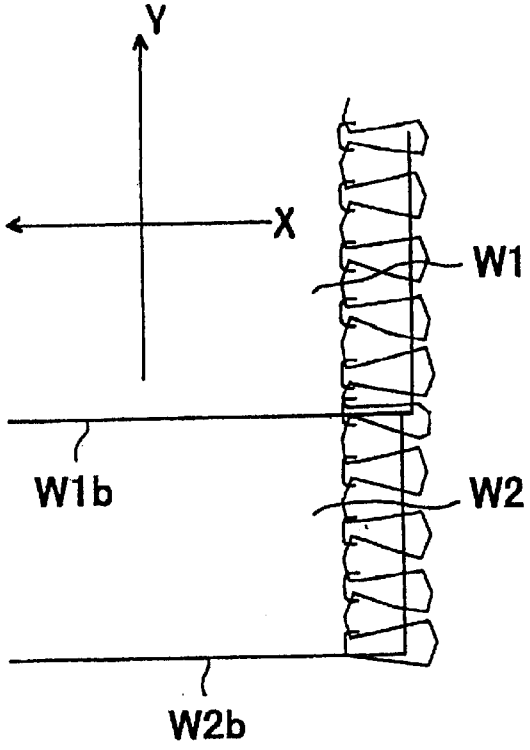
FIG. 5 is a plan view illustrating "plyshift" that is one of defective sewing.

FIG. 2 is a block diagram showing the configuration of a control circuit in the apparatus according to the present invention. The control circuit 9 controls the basic operation program for the sensor 6 and a sewing machine motor (not shown). The control circuit 9 comprises a sensor circuit 15 and a control unit 16. The sensor circuit 15, as shown in FIG. 3, comprises an amplifier circuit 6*d* and input signal terminal 6*e*. When the rectangular waves always outputted from oscillation circuit 6*c* pass through the sensor 6 (between the photo emission unit 6*a* and photo acceptance unit 6*b*), their rising edges collapse according to the thickness, number of sheets, colors, etc. of the cloth. The collapsed rectangular waves are amplified by the amplifier circuit 6*d*. The quantity of transmitted light amplified by the amplifier circuit 6*d* is inputted into the input signal terminal 6*e*, and the values of the quantity of transmitted light inputted into the input signal terminal 6*e* in a few stitches of initial sewing operation are averaged at the control unit 16 and stored as a standard average value. The standard average value is not a simple average value but a value obtained by adding a predetermined standard error value to the simple average value.

The standard average value of the quantities of transmitted light stored in the control unit 16 of the control circuit 9 is compared with the value of the transmitted light accepted by the photo acceptance unit 6*b* of the sensor 6 with advance of sewing after a few stitches of initial sewing operation. According to the result of comparison, it is judged that defective sewing is not generated if the value of the accepted light is equal to or less than the standard average value, and that defective sewing has occurred if the value of the accepted light is larger than the standard value and is smaller than the value of the quantity of light transmitted without cloth, and that sewing operation has completed if the value of the accepted light is equal to the value of the quantity of light transmitted without cloth.

Warning means 10, a selective operation member 11, an invalid section setting member 12 and a reset switch 13 are respectively connected to the control circuit 9. Warning means 10 comprises a warning lamp 10*a*, warning buzzer 10*b* and motor stop signal output portion 10*c*. The selective operation member 11 can change the warning sound of the warning buzzer 10*b* in the warning means 10 to a different kind of sound. The invalid section setting member 12 can invalidate the detection of defective sewing during sewing operation in a predetermined section. The reset switch 13 is able to stop the operation of the warning means 10. The invalid section setting member 12 is configured so as to invalidate the rotation signal S1 inputted to the control circuit 9 from a rotation detector 14 disposed at the rotary section of a sewing machine pulley or the like.

According to the apparatus having the above configuration, when defective sewing is detected during sewing operation as described above, the warning means 10 is actuated by warning output signal S3 outputted from the control unit 16 of the control circuit 9. With the warning means 10 actuated, the warning lamp 10*a* and warning buzzer 10*b* are started to function, and also, motor stop signal S4 is outputted from the motor stop signal output portion 10*c* to a sewing machine driving motor (not shown), thereby stopping the driving of the sewing machine.

When a plurality of sewing machines adjoining to each other are operated at the same time, the warning sound from the warning buzzer 10*b* can be previously changed to a different kind of sound for every machine by operating the selective operation member 11 of each sewing machine, and it is possible to quickly and precisely be sure of the sewing machine in sewing trouble (defective sewing) by discriminating the warning sound from those predetermined for other sewing machines.

Also, in sewing of special products, which includes a form of sewing section similar to misalignment or plyshift, it is preferable to previously invalidate the detection of defective sewing in the special sewing section by operating the invalid section setting member 12. In this way, unnecessary detection of defective sewing and resultant generation of a warning sound can be avoided, and thereby, the intended special sewing can be appropriately performed.

The operation of the warning means 10 can be immediately stopped when inputting the reset signal S2 to the control circuit 9 by operating the limit switch 13.

The entire disclosure of Japanese Patent Application No. 2000-269653 filed on Sep. 6, 2000 including specification, claims, drawings and summary are incorporated herein by reference in its entirety.

What is claimed is:

1. An apparatus for detecting defective sewing by the sewing machines, said apparatus comprising:

a sensor for detecting the quantity of light transmitted through cloths passing over a needle plate, said sensor being disposed near a needle drop portion of the needle plate, and a control circuit for checking defective sewing from increase and decrease of said light quantity, wherein said control circuit comprises means for storing the averaged value of the light transmitted in a few stitches of initial sewing operation, and means for determining defective sewing during sewing operation continuously from the initial sewing operation by comparing the stored average value with the value of the light transmitted and detected each time.

2. An apparatus for detecting defective sewing by the sewing machines as defined in claim 1 wherein the standard average value of transmitted light stored in said control circuit is set to a value obtained by adding a predetermined standard error value to a simple average value.

3. An apparatus for detecting defective sewing by the sewing machines as defined in claim 1 wherein said control circuit is connected to warning means for generating a warning sound in case of detecting defective sewing, and a selective operation member which is able to change the warning sound from said warning means to a different kind of warning sound.

4. An apparatus for detecting defective sewing by the sewing machines as defined in claim 2 wherein said control circuit is connected to warning means for generating a warning sound in case of detecting defective sewing, and a selective operation member which is able to change the warning sound from said warning means to a different kind of warning sound.

5. An apparatus for detecting defective sewing by the sewing machines as defined in claim 1 wherein said control circuit is connected to an invalid section setting member which is able to invalidate the detection of defective sewing during sewing operation in a predetermined section.

6. An apparatus for detecting defective sewing by the sewing machines as defined in claim 2 wherein said control circuit is connected to an invalid section setting member which is able to invalidate the detection of defective sewing during sewing operation in a predetermined section.

7. An apparatus for detecting defective sewing by the sewing machines as defined in claim 3 wherein said control circuit is connected to an invalid section setting member which is able to invalidate the detection of defective sewing during sewing operation in a predetermined section.

* * * * *